US007118487B2

(12) United States Patent
Turcot

(10) Patent No.: US 7,118,487 B2
(45) Date of Patent: Oct. 10, 2006

(54) INFLATABLE SPORT BALL ARRESTING STRUCTURE

(76) Inventor: Jean-Marc Daniel Turcot, 240 Clifton Road North, Kelowna, British Columbia (CA) V1V 1N3

( * ) Notice: Subject to any disclaimer, the term of this patent is extended or adjusted under 35 U.S.C. 154(b) by 0 days.

(21) Appl. No.: 11/070,201

(22) Filed: Mar. 3, 2005

(65) Prior Publication Data

US 2005/0197212 A1 Sep. 8, 2005

Related U.S. Application Data

(60) Provisional application No. 60/549,168, filed on Mar. 3, 2004.

(51) Int. Cl.
*A63B 63/00* (2006.01)

(52) U.S. Cl. ..... 473/197; 273/400

(58) Field of Classification Search ..... 273/398–402, 273/395, 396, 407; 473/476, 478, 197
See application file for complete search history.

(56) References Cited

U.S. PATENT DOCUMENTS 3,156,471 A * 11/1964 Bibeau ..... 473/164
5,088,740 A * 2/1992 Peterson ..... 273/410
5,269,527 A * 12/1993 Noval ..... 473/197
5,865,693 A * 2/1999 Johnson ..... 473/478
5,941,529 A * 8/1999 Kinsey ..... 273/401
6,716,122 B1 * 4/2004 Vermeulen ..... 473/476
6,926,060 B1 * 8/2005 Mark ..... 160/135

FOREIGN PATENT DOCUMENTS

GB 2172509 A * 9/1986

* cited by examiner

*Primary Examiner*—Mark S. Graham
(74) *Attorney, Agent, or Firm*—Antony C. Edwards

(57) ABSTRACT

A sport ball arresting structure may be characterized in one aspect as including an inflatable quadra-pod mounted on a substantially rectangular flexible planar base for placement on the ground. The quadra-pod includes four legs formed, when the quadra-pod is inflated, by two criss-crossed inflatable tubes forming a dome. The tubes are criss-crossed at a vertex of the quadra-pod. Lower ends of the four legs are mounted to the four corners of the base, one lower end per corner. A flexible net is mounted within the dome so as to drape completely across the interior of the dome and parallel to an entrance to the structure defined by a front pair of legs and a front edge of the base.

20 Claims, 7 Drawing Sheets

INFLATABLE SPORT BALL ARRESTING STRUCTURE

CROSS REFERENCE TO RELATED APPLICATION

This application claims priority from U.S. Provisional Patent Application Ser. No. 60/549,168 filed Mar. 3, 2004 entitled Inflatable Sport Ball Arresting Structure.

FIELD OF THE INVENTION

This invention relates to an inflatable frame for supporting a ball-arresting screen, generally in the form of netting, for use when practicing, byway of example, 'full-swing' hitting of a golf ball with driving or chipping clubs within a confined space such as a residential back yard.

BACKGROUND OF THE INVENTION

When one practices the various driving or chipping strokes in the game of golf which elevate the golf ball so that it can travel a fairly long distance, one must generally attend a specialised driving range or similar facility. Such facilities may require some travel time, expense and inconvenience to attend and may not be readily available to all golfers. Due to the danger from the impact of such a driven ball the avid golfer is prohibited from practising at home in a residential back yard.

The desire on the part of players of sports such as golf, baseball, hockey or soccer to improve their ability and thereby increase their enjoyment of their game requires considerable 'full-swing' practice. The inflatable sport ball arresting structure according to the present invention permits such practice to be undertaken at home in a carport or garage or in a residential backyard with convenience and safety. It is an object to provide such a device which is lightweight, compact for home storage and easily assembled, and further which is simple to erect, readily storable without disassembly, and resistant to displacement through sport ball impact or wind gust. Further yet, the device may inhibit ricochet of the sport ball.

In the prior art, applicant is aware of U.S. Pat. No. 6,511,390 which issued Jan. 28, 2003 to Kim for a Sports Ball Net Assembly, which discloses a net supporting structure comprising rigid and flexible pipes.

Applicant is further aware of U.S. Pat. No. 6,135,894 which issued Oct. 24, 2000 to Cho for a Collapsible Golf Net, which discloses a flexible, closed loop shaped net support structure which is supported on stakes positioned in the ground. Additional straps are used to deform the net support structure into a concave shape and to lend stability.

It is one of several objects of the present invention to provide that which is missing in the prior art; namely, a sport ball arresting structure having an inflatable frame and a flexible base to provide a lightweight frame and permitting ease of assembly, deployment and storage after use.

SUMMARY OF THE INVENTION

The present invention is a sport ball arresting structure for supporting a net. The structure includes an inflatable frame comprising an arcuate first pair of legs which may be a single arcuate inflatable tube to provide such a supporting member and at least one second supporting member which may in a tri-pod embodiment be shorter than the first supporting member or of equal length in a quadra-pod embodiment. The structure supports a net so as to present a net face through an opening in an entrance defined by the structure. In the tri-pod embodiment the at least one second supporting member braces the first supporting member so as to brace the first supporting member, in one embodiment, upright in a generally vertical plane. A flexible base which may be a sheet or strapping forming a polygon on the ground, such as an isosceles triangle in the tri-pod embodiment or a rectangle or square in the quadra-pod embodiment provides a ground template. The supporting members are mounted onto the ground template so that, when the supporting members are sufficiently inflated, the structure is at least semi-rigid and forms a braced tri-pod, quadra-pod, etc, the number of corners corresponding to the number supporting legs (that is three for the tri-pod, four for the quadra-pod, etc). As used herein, tri-pod or quadra-pod is not meant to necessarily mean that the legs of the tri-pod or quadra-pod are linear or of equal length, but rather as used herein tri-pod or quadra-pod is intended to include the use of curved or arcuate legs. Further, the use herein of the coined-word "multi-pod" is intended to mean support structures forming a domed or "tepee-like" shape by the use of at least three (tri-pod) and including four (quadra-pod) or more legs.

The first pair of legs which, again, may be a single inflatable tubular supporting member, is secured at each of its lower ends to the respective corresponding corners, extremities or ends of the base.

In the tri-pod embodiment, where the first pair of legs is a single inflatable first supporting member, that member is of a substantially greater length than that of the corresponding edge of the base, which is shaped as an isosceles triangle and which may be formed by the flexible strapping template so that upon inflation of the first supporting member, the first supporting member deforms into an arcuate shape, in one embodiment a semi-circle. The semi-circle may for example have an approximate radius of seven feet. The third leg of the tri-pod may be secured at one of its ends to a medial point along the first supporting member and at its other end to the apex, opposite the base, of the isosceles triangle formed by the flexible strapping template. The first and second supporting members are maintained in pneumatic fluid communication with each other via a small diameter flexible pneumatic airway such as a tube connecting the first and second supporting members at the medial along the first supporting member. The airway may have a pressure relief valve mounted thereon or one may be provided on one of the supporting members. Inflation of the first supporting member through a one-way valve thus provides for simultaneous inflation of the second supporting member. Inflation of both members to approximately 20 psi results in a freestanding, self-supporting structure. A sport ball arresting net is then mounted to the structure.

Each supporting member may be enclosed within a protective tubular fabric sleeve. The sleeve may have integral loops or tie points formed at intervals along its length to facilitate attachment of netting and stability cord. The normally open ends of the protective fabric sleeve may be closed by stitching or other suitable means and may secure additional fabric loops for facilitating attachment to the flexible ground template strapping.

Without intending to be limiting, in embodiments where the radius of the arcuate shape of the first supporting member, and thus the entrance to the structure, is seven feet, the first supporting member may be approximately twenty-two feet in length. Thus the isosceles triangle of the flexible strapping template will have a base of fourteen feet and sides of ten feet. The second supporting member will then be approximately ten feet in length.

A flexible backstop, baffle or net (collectively referred to herein as a net) having a mesh size and durability suitable to prevent the passage of the sports ball through the net when forcefully impacting the net, is secured to the first supporting member for example by first lapping the net around the first supporting member and then tying it at intervals along the member so that the net depends generally vertically and radially inwardly of the first supporting member so as to cover the entrance. The net advantageously is of a sufficient length to lie in folds on the ground so that when impacted by a ball the net will billow or deflect slightly in the direction of impact without the danger of the ball either passing beneath or through the net or rebounding toward the user. The use of inflatable tubes also may inhibit rebound of the sports ball from the net supporting structure.

In summary, the sport ball arresting structure according to the present invention may be characterized in one aspect as including an inflatable multi-pod mounted or mountable on a circular, obround, or substantially polygonal flexible planar base for placement on the ground wherein the number of sides of the polygon, which may be a regular polygon, correspond to the number of legs of the multi-pod. Flexible material such as mesh may enclose the multi-pod with the exception of the entrance. The multi-pod includes a pair of legs lying, when the multi-pod is inflated, in an entrance plane and supported upwardly, for example substantially upright by at least one brace leg of the multi-pod. Upper ends of the pair of legs and the brace legs meet at a vertex of the multi-pod. Lower ends of the pair of legs and the brace legs, opposite the upper ends, are mounted or mountable to corresponding corners of the base, one lower end per corner, or if the base does not have distinct vertices or corners, then the legs may be radially spaced apart, for example equally radially spaced apart about a vertical axis through the vertex of the multi-pod. A flexible net is mounted or mountable around upper edges thereof to or between the multi-pod legs, for example by attachment directly to the legs or to the mesh between the legs, so as to drape completely across the cavity of the multi-pod defined by the legs of the multi-pod and parallel to a front edge of the base lying in the entrance plane.

In one embodiment, one or each pair of legs are formed of a single inflatable tube which is arcuate when inflated so as to form an arcuate arch over, that is, around an upper perimeter of, the cavity of the multi-pod. Thus in the quadra-pod embodiment the four legs may be formed by two inflatable tubes. Each inflatable tube may be resilient, its opposite ends mounted to respective two opposite corners or opposite sides of the base. Each such inflatable tube is of greater length than the corresponding diameter or dimension of the base and thus inflates arcuately, that is, inflates to form an arch over the cavity of the multi-pod. In one embodiment each such arch is substantially semi-circular.

In the tri-pod embodiment the legs include a first pair of legs formed from a single inflatable tube and a brace leg formed from a separate linear or arcuate inflatable pneumatic tube, where the two inflatable tubes, are pneumatically connected or connectable to each other by an auxiliary airway for simultaneous inflation of both tubes. Advantageously, in all embodiments of the multi-pod, each inflatable tube or leg is in pneumatic communication with other of the inflatable tubes or legs so that the multi-pod is simultaneously inflatable in whole or in part.

In each embodiment the base may include or consist solely of straps extending from and linearly between the lower ends of all of the legs so as to outline the perimeter of the polygon, circle etc formed by the base.

The net is advantageously of larger area than the area defined by the entrance. The net may extend laterally across the cavity or enclosure of the multi-pod beyond the side edges of the entrance when viewed looking in through the entrance. Another extra portion of the net may lie for example loosely in folds on the base or on a base plane containing the base when the base is on the ground to provide for billowing of the net upon a ball impacting the net. Again advantageously, the net is loosely draped so as to hang down from or between the legs of the multi-pod so as to be free to deflect and deform rearwardly of the entrance and into the enclosure defined by the multi-pod structure upon entry of the sport ball through the entrance and impacting of the ball with the net. Thus the net may be sufficiently large so as to billow rearwardly of the entrance and across, for example entirely across, the base towards the brace leg or legs supporting the entrance and net upon impact of the ball to thereby absorb or attenuate translational energy of the ball, for example the energy and momentum of a golf ball in flight.

DETAILED DESCRIPTION OF EMBODIMENTS OF THE INVENTION

Figure 1:
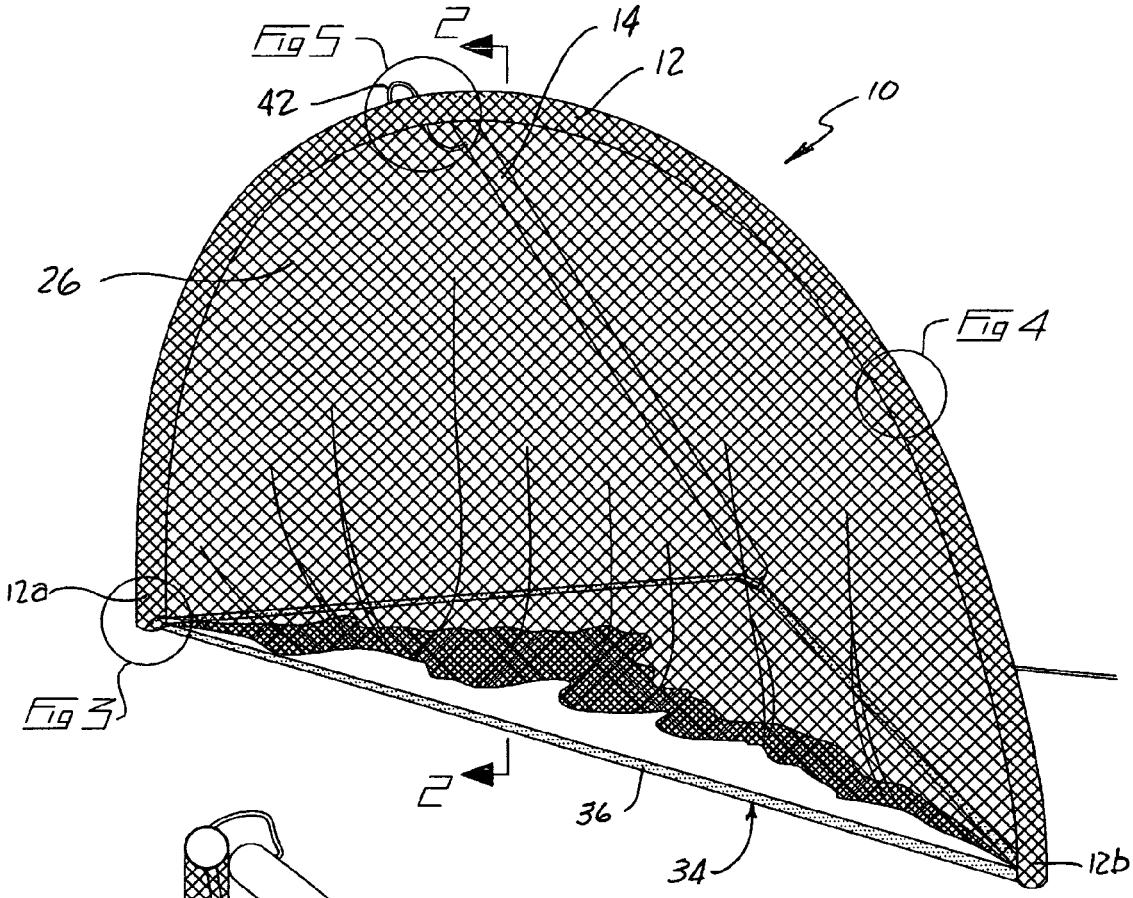
FIG. 1, is a front perspective view of one embodiment, a tri-pod embodiment, the sport ball arresting structure according to the present invention.
Figure 2:
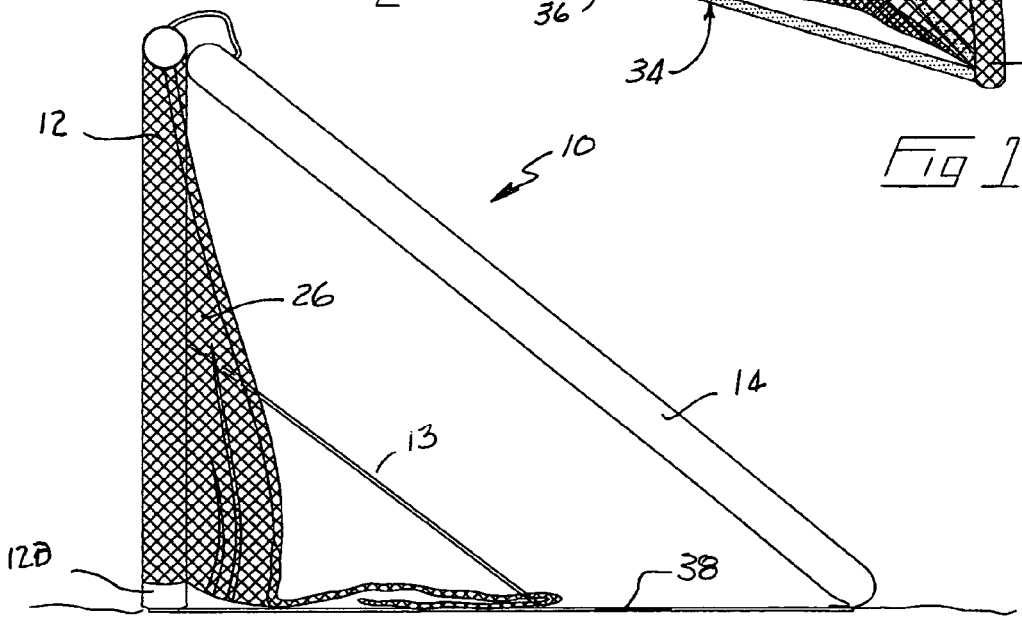
FIG. 2 is a cross sectional view along line 2—2 in FIG. 1.
Figure 2D:
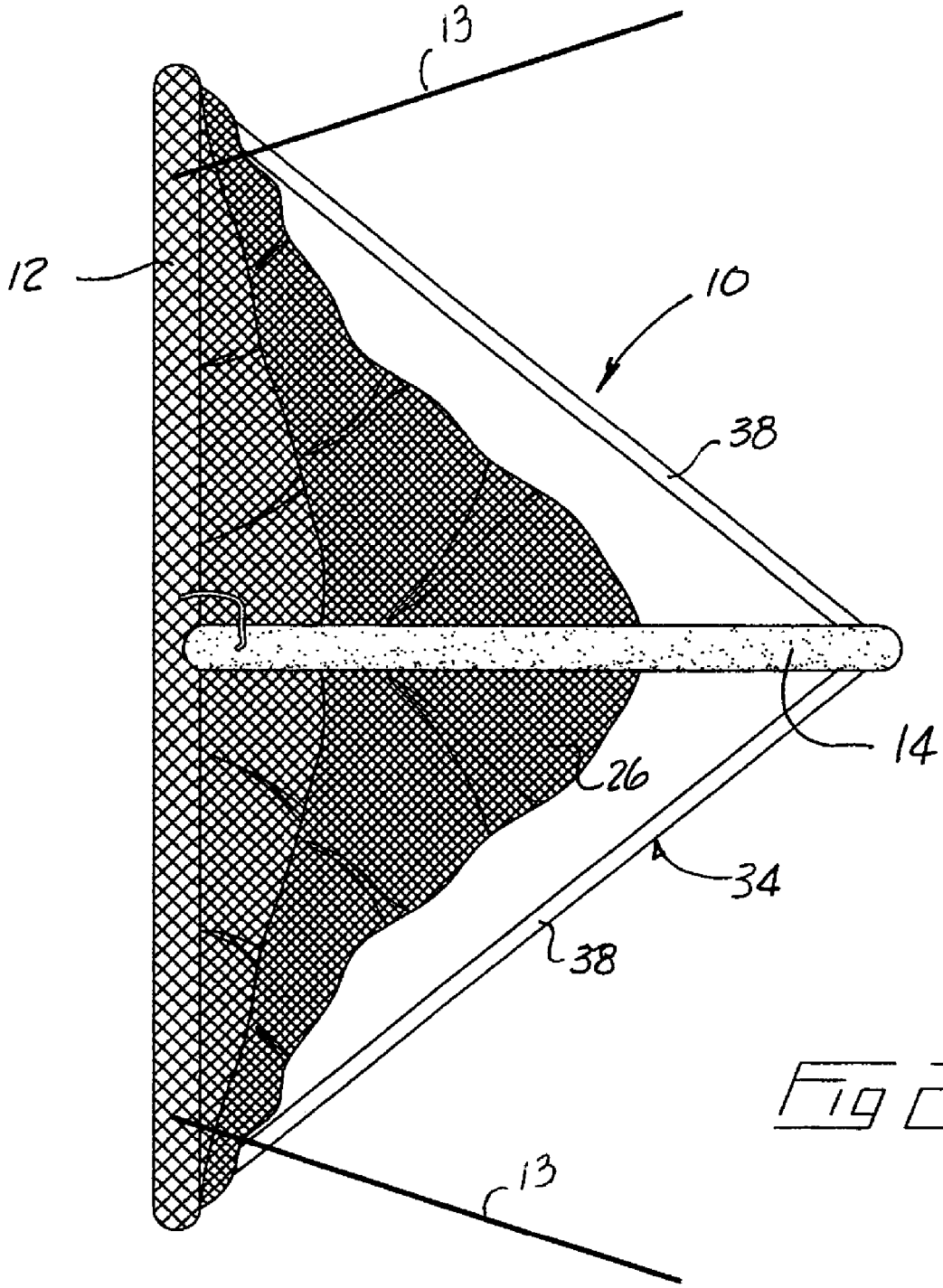
FIG. 2*a* is a plan view of the sport ball arresting structure of FIG. 1.
Figure 3:
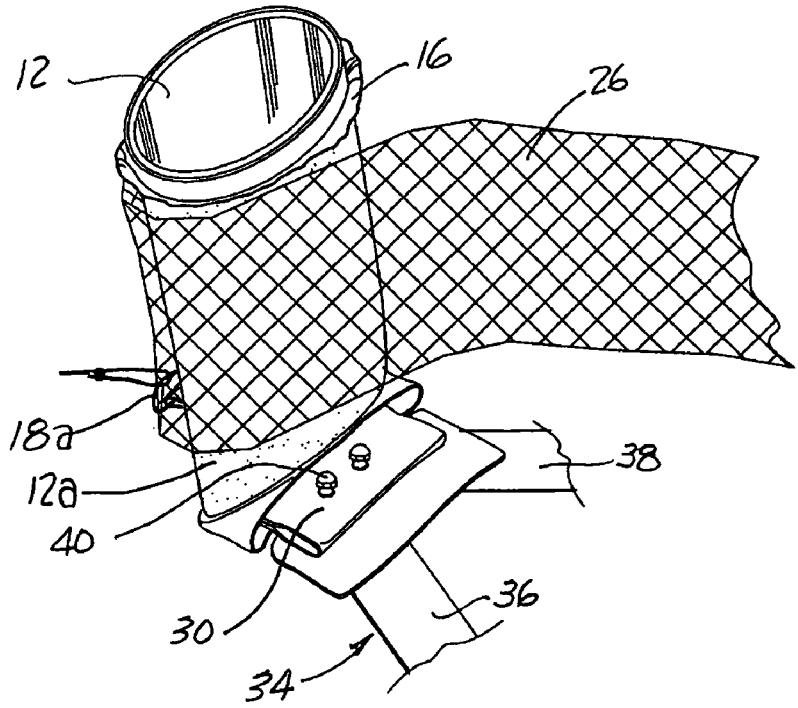
FIG. 3 is an enlarged perspective view of a portion of FIG. 1 illustrating a typical connection detail between support structure and ground template.
Figure 4:
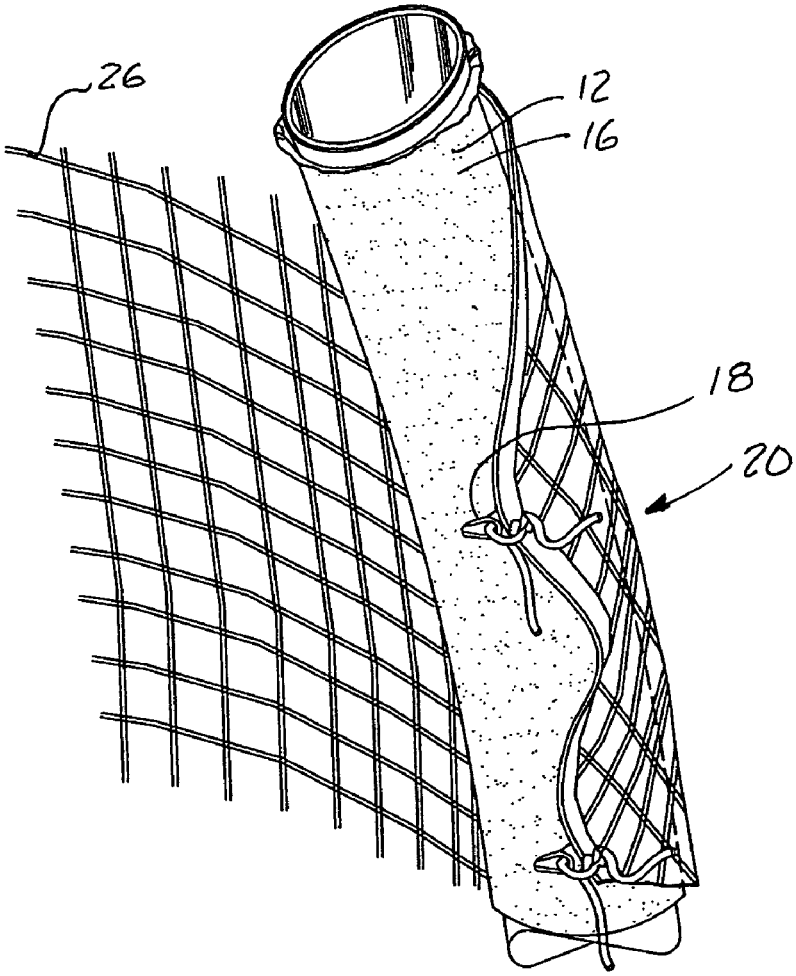
FIG. 4 is an enlarged perspective view of a portion of FIG. 1 illustrating a typical connection detail between net and support structure.
Figure 5:
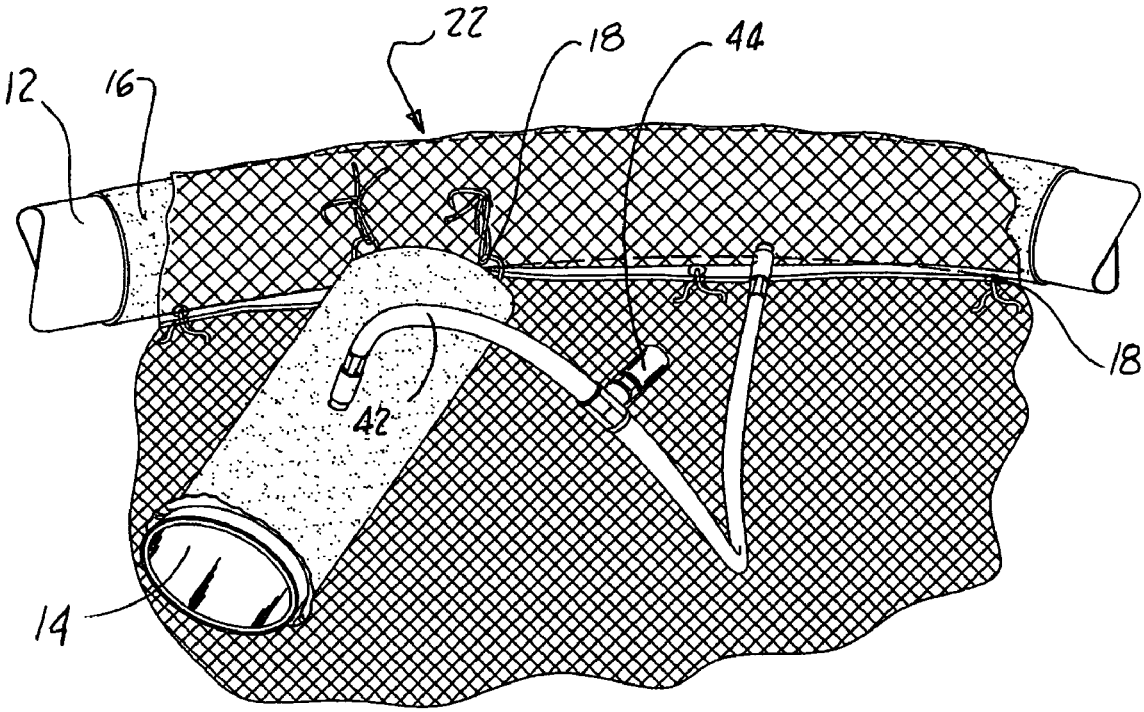
FIG. 5 is an enlarged perspective view of a portion of FIG. 2 illustrating the flexible pneumatic airway interconnection of the support structure.
Figure 6:
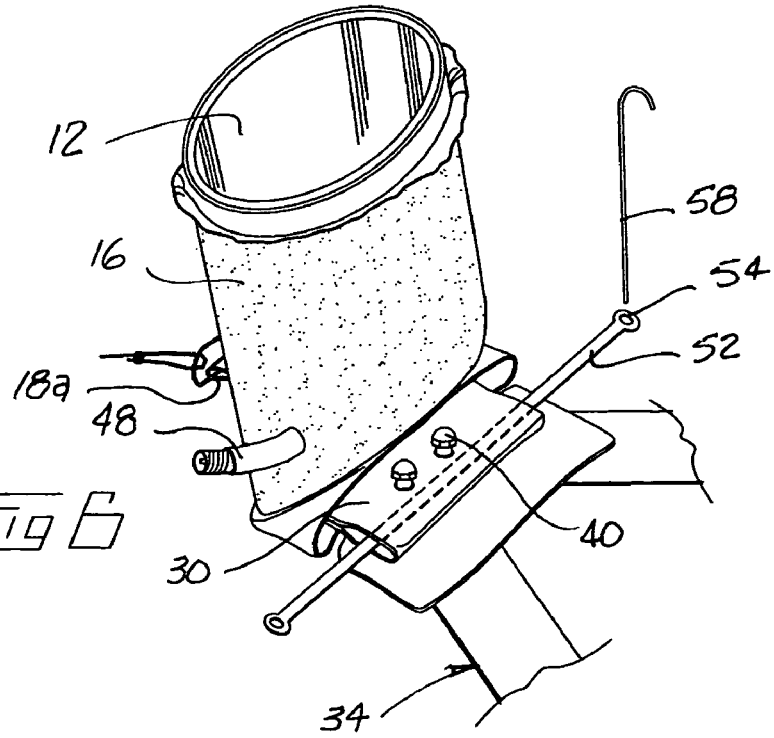
FIG. 6 is an enlarged perspective view similar to FIG. 3 illustrating a stability ground connection.

With reference to the drawing figures, wherein similar characters of reference denote corresponding parts in each view, in the tri-pod embodiment of FIGS. 1–6, sport ball arresting structure 10 has first and second elongate support members 12 and 14 respectively. Each member is an inflatable resilient, for example rubber, tube or other inflatable tube which may be enclosed by a nylon or other flexible but preferably not resilient fabric sheath 16. Sheaths 16 may, in one embodiment not intended to be limiting, have loops 18 integrally formed on or sewn thereto at intervals along a longitudinal seam to facilitate a tied connection. Such tied connection as shown at 20 in FIG. 4 facilitate connection between a supporting member or leg and backstop netting 26. As shown in FIG. 5 such tied connection as shown at 22 secures second elongate support member 14 at the medial position on first member 12. As may be seen in FIG. 3 additional loops 18*a* are provided on first member 12 for connection to tie-downs 13 to resist wind forces. Sheath 16 on first support member 12 may have a flexible fabric such as tab 30 attached at each end of the sheath. The second support member 14 may require only one such tab 30 at only one of its ends.

A fabric template 34 of generally triangular configuration having a base 36 and sides 38 may be placed upon the ground or other playing surface and the elongate support members 12 and 14 respectively fastened thereto by means of fasteners 40 or the like engaging tabs 30. Support member 12 is of a length that when its extremities 12*a* and 12*b* are fastened to the ends of base 36 of triangular template 34, it becomes deformed during inflation into an arcuate, such as a semi-circular, shape. Support member 14 on the other hand, is of a shorter length than member 12 and when inflated becomes a rigid linear support secured to the medial point of member 12 and extending downwardly sloping toward the apex of template 34 and secured thereto by means of fasteners 40 which pass through fabric tab 30 and template 34.

Supporting members 12 and 14 are in pneumatic fluid communication with each other via a small diameter flexible airway such as tube 42. Tube 42 may be provided with a pressure relief valve 44. Pressurized air is introduced through one-way valve 48 located near one end of support member 12. Flexible tube 42 allows such air to pass freely into second support member 14 thereby allowing simultaneous inflation of both support members. As support members 12 and 14 become fully inflated, the three sides of triangular template 34 are tensioned thereby maintaining stability of the structure.

Additional stability in a direction transverse to first support member 12 after assembly and inflation may be achieved by inserting an elongate rigid bar 52 through the looped fabric of tabs 30 sewn into each end of covering sheath 16. Bar 52 may have an aperture 54 at each of its ends for pinning by way of rod 58 to the ground.

Figure 7:
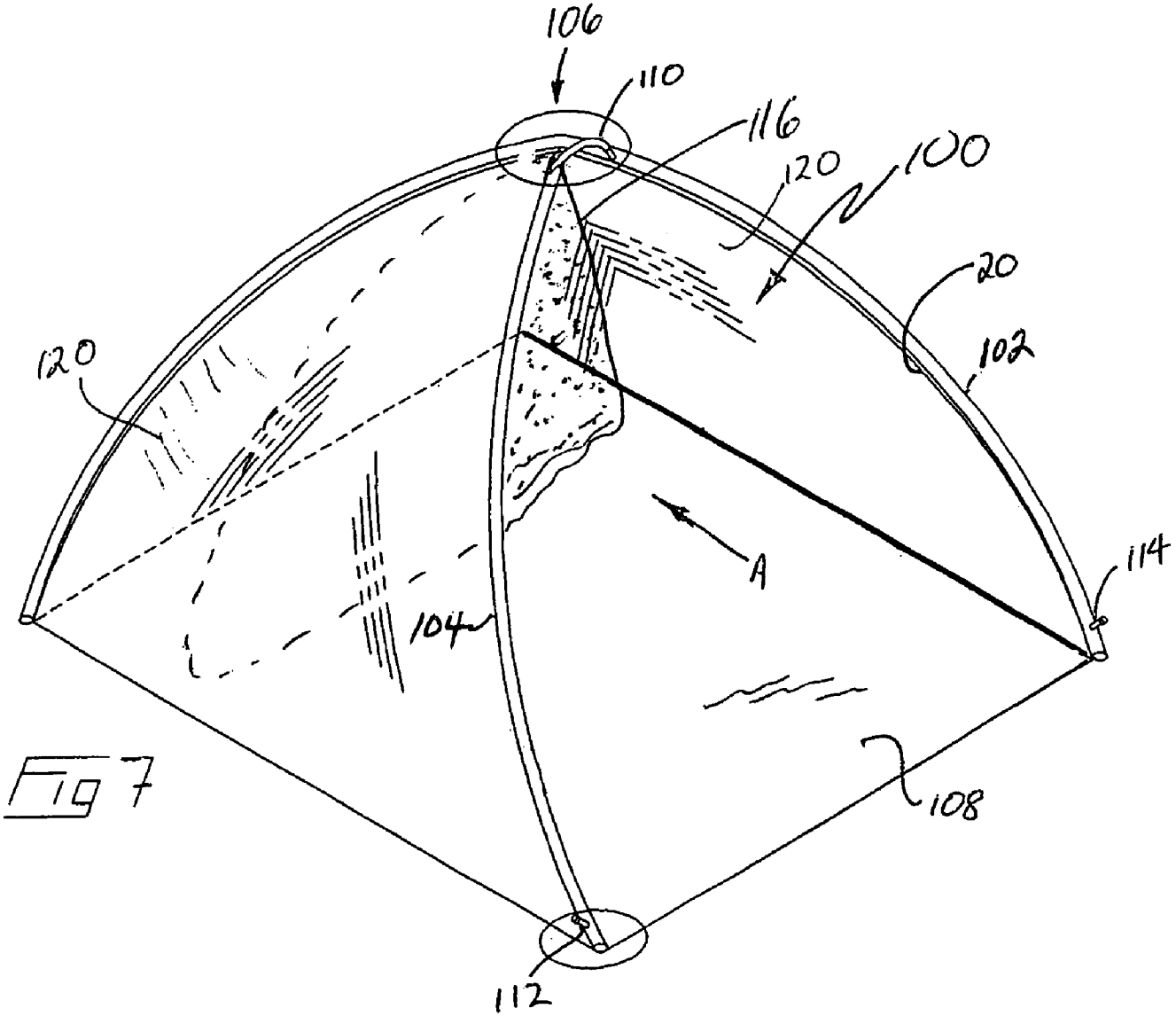
FIG. 7 is a perspective view of an alternative quadra-pod embodiment of the present invention showing the pneumatic interconnection of the two inflatable support tubes forming the four legs.
Figure 8:
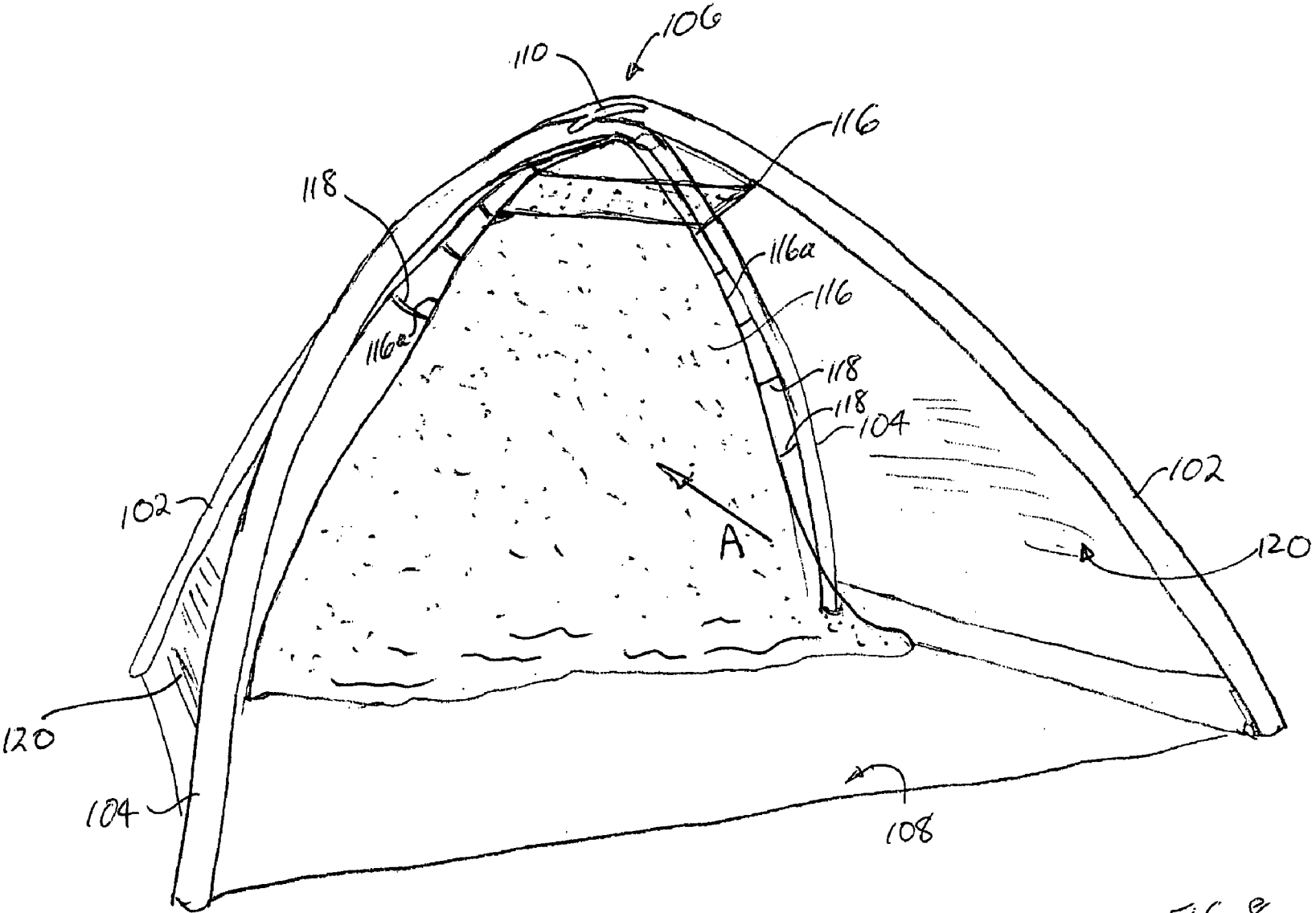
FIG. 8 is a perspective of the quadra-pod of FIG. 7 better illustrating the anchoring of the ends of the two inflatable tubes to the four corners of the base.
Figure 9:
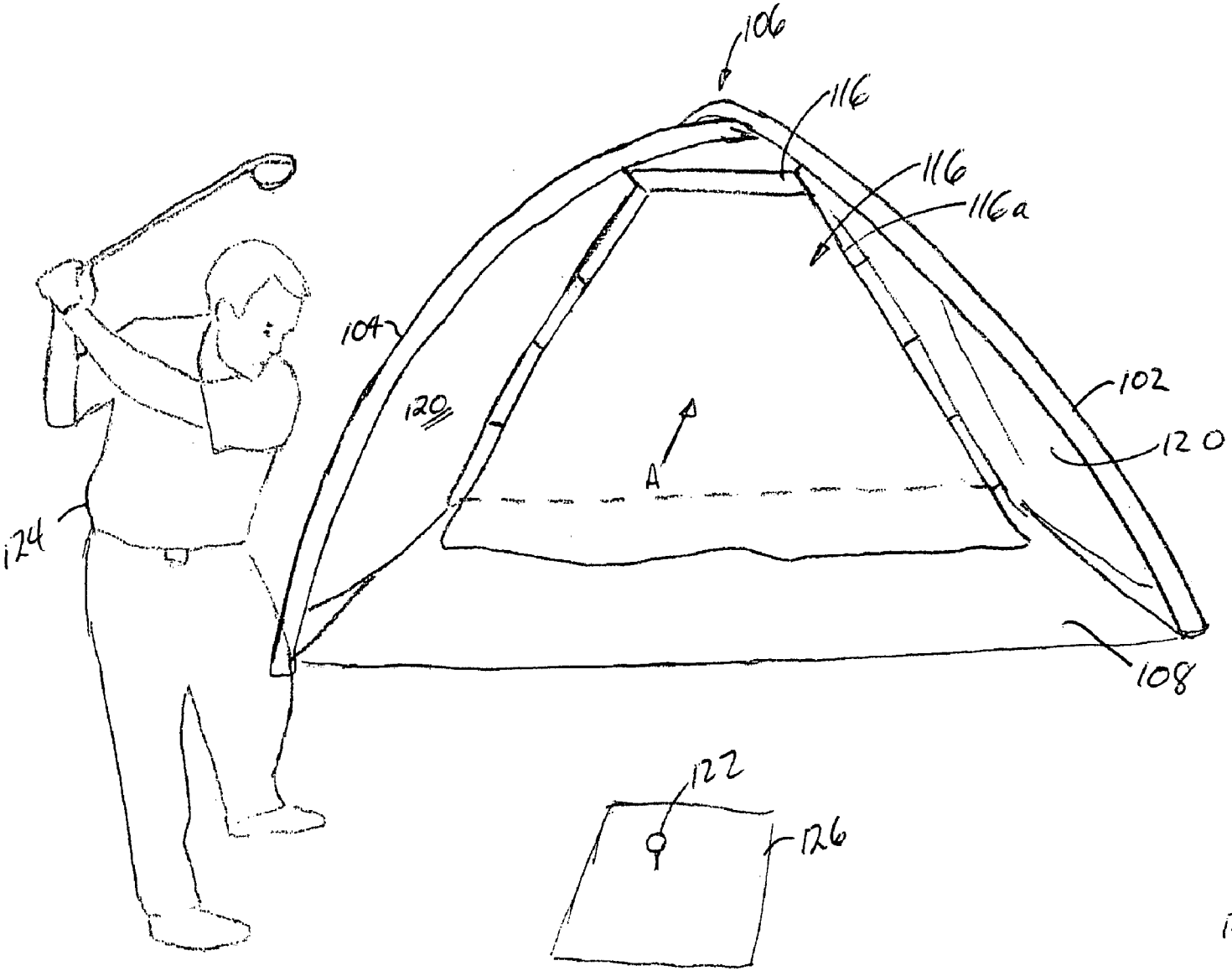
FIG. 9 is a front view of the quadra-pod of FIG. 8 illustrating use of the quadra-pod for practicing a golf swing.

A further example of the inflatable multi-pod structure 100 according to the present invention is depicted in FIGS. 7–9, wherein the four legs of a quadra-pod embodiment are formed by two, pneumatically interconnected, inflatable tubes 102 and 104. Tubes 102 and 104 criss-cross at vertex 106. The ends of tubes 102 and 104 are mounted, for example in a manner similar to that illustrated in FIG. 3, to the corresponding four corners of base 108. Base 108 may be a single flexible square or rectangular sheet, or may be formed as a template or an outline of straps for example in the manner illustrated for the tri-pod embodiment of FIGS. 1–6. Tubes 102 and 104 are advantageously pneumatically interconnected by flexible tube 110. A pressure relief valve 112 may also be provided, for example, on the end of one of the tubes. An inflation valve 114 is provided, for example, on one end of the other tube.

A backstop net 116, which in a preferred embodiment is of flexible mesh, is suspended within the enclosure or cavity defined by tubes 102 and 104. In one embodiment, the upper edges 116*a* of net 116 are suspended from the rear pair of legs, that is, from the rearward ends of tubes 102 and 104, for example, by suspension means such as for example flexible and/or resilient straps 118. Net 116 is suspended either from the rear pair of legs or from the flexible material forming the side walls 120 extending between and mounted to tubes 102 and 104. The intention is to suspend net 116 generally vertically within the enclosure but without making net 116 sufficiently taut so as to cause rebound of a ball 122 striking the net.

The use of the pneumatic support structure provides a resiliency to the entire supporting frame and thus this resiliency is transmitted to net 116 via straps 118. Thus, it is not merely the billowing of net 116 when struck by ball 122 forcefully impacting net 116 when driven in direction A, that accounts for the entire dampening of the motion of the ball such as when ball 122 is struck by a golfer 124 from a practice tee 126 placed directly in front of the entrance to the quadra-pod structure. Because the pneumatic tubes are by their nature, somewhat resilient, not only are rebounds of ball 122 from tubes 102 and 104 of less force than would be the case given rigid supporting tubes such as made of metal, but also, the force of the ball hitting the net is transmitted laterally along the mesh of the net and into the support structure. Consequently, the force of the ball strike is attenuated not only by the net billowing but also by the slight deflection rearwardly of the quadra-pod structure, or the multi-pod structure in other embodiments, itself Although the physical movement of the structure may be very minor, the force of the ball is also transmitted as energy into the pneumatic frame, whether the ball is driven into the net, or, on a slice shot, where the ball is driven into a side wall 120 or into one of the supporting tubes 102 or 104. In any event, energy from the shot is transmitted in lesser or more degree typically as tension along the strands of the net and straps 118 and vibration into the pneumatic supporting structure of the multi-pod.

Thus, an inflatable multi-pod ball arresting net supporting structure according to the present invention, such as the tri-pod and quadra-pod designs illustrated, which are not intended to be limiting, provide for a relatively lightweight, for example in the order of thirty pounds, and portable erectable structure which provides a practice enclosure. For example, in one embodiment the enclosure may include a base of eleven by nine feet and a height of over six feet into which a sport ball may be driven, and wherein the entire structure may be quickly inflated by the use of compressed air or by means of a manual pump, and equally as quickly deflated for compact storage.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A golf ball arresting structure for supporting a net and inhibiting ricochet of a golf ball driven into the structure, the structure comprising:

an inflatable multi-pod, including at least a tri-pod, mounted on a flexible planar base for placement on the ground;

said multi-pod including a pneumatically resilient first pair of legs defining, when said multi-pod is inflated, an entrance lying substantially in an entrance plane and supported in an upward inclination by at least one brace leg, said at least one brace leg also pneumatically resilient, upper ends of said first pair of legs and said at least one brace leg meeting at a vertex of said multi-pod, lower ends of said first pair of legs and said at least one brace leg, opposite said upper ends, mounted to opposite sides of said base, a flexible net mounted by suspension means so as to be suspended between said legs so as to drape said net completely across a cavity of said structure defined by said first pair of legs and said at least one brace leg so that said net is substantially parallel to a front edge of said base lying in said entrance plane, said suspension means transmitting energy, from impact of a golf ball driven into said net through said entrance, from said net to said multi-pod for energy-absorbing and/or energy attenuating deformation of said net, and said multi-pod, wherein, said net is of larger area than the area defined by said entrance so as to have, when relaxed until struck by the golf ball, a portion of said net lying loosely in folds on a base plane containing said base when said base is on the ground, and wherein said net is loosely draped so as to hang down within said cavity and so as to be free to deflect and deform rearwardly of said entrance and rearwardly across said cavity upon entry of the golf ball through said entrance and impact of the golf ball with said net.

2. The structure of claim 1 wherein said first pair of legs and said at least one brace leg are four legs formed by a pair of inflatable tubes criss-crossed at said vertex, said inflatable tubes arcuate when inflated so as to form arcuate arches defining said cavity and an archway around an upper perimeter of said entrance.

3. The structure of claim 2 wherein said inflatable tubes are resilient, opposite ends of said inflatable tubes mounted to respective corners of said base, said inflatable tubes each of greater length than edge dimensions of said base and thus inflating arcuately when inflated so as to form said arches and archway.

4. The structure of claim 3 wherein said arches are substantially semi-circular.

5. The structure of claim 1 wherein said entrance is defined by a single arcuate inflatable tube forming a front pair of legs of said multi-pod and wherein said at least one brace leg is a separate pneumatic tube, separate from said single arcuate inflatable tube.

6. The structure of claim 5 wherein said at least one brace leg is linear when inflated, and pneumatically connected to said single arcuate inflatable tube by an auxiliary airway for simultaneous inflation of both said tubes.

7. The structure of claim 5 wherein said base is substantially in the shape of an isosceles triangle.

8. The structure of claim 7 wherein said base includes three swaps extending from and linearly between said lower ends.

9. The structure of claim 7 wherein said base consists solely of three straps extending from and linearly between said lower ends.

10. The structure of claim 1 wherein said net is sufficiently large so as to billow rearwardly across said base upon said impact of the sport ball to thereby absorb or attenuate translational energy of said sport ball.

11. The structure of claim 10 wherein said net is sufficiently large so as to billow substantially entirely across said base and rearwardly substantially to said at least one brace leg.

12. A sport ball arresting structure for supporting a net comprising:

an inflatable multi-pod, including at least a tri-pod, mounted on a flexible planar base for placement on the ground, said multi-pod including a pneumatically resilient first pair of legs defining, when said multi-pod is inflated, an entrance lying substantially in an entrance plane and supported in an upward inclination by at least one brace leg, said at least one brace leg also pneumatically resilient, upper ends of said first pair of legs and said at least one brace leg meeting at a vertex of said multi-pod, lower ends of said first pair of legs and said at least one brace leg, opposite said upper ends, mounted to opposite sides of said base, a flexible net mounted by suspension means so as to be suspended between said legs so as to drape said net completely across a cavity of said structure defined by said first pair of legs and said at least one brace leg so that said net is substantially parallel to a front edge of said base lying in said entrance plane, said suspension means transmitting energy, from impact of a sport ball driven into said net through said entrance, from said net to said multi-pod for energy-absorbing and/or energy attenuating deformation of said net, and said multi-pod, wherein said net is of larger area than the area defined by said entrance so as to have a portion of said net lying on a base plane containing said base when said base is on the ground, and wherein said net is loosely draped so as to hang down within said cavity and so as to be free to deflect and deform rearwardly of said entrance and rearwardly across said cavity upon entry of the sport ball through said entrance and impact of the sport ball with said net, wherein said net is sufficiently large so as to billow rearwardly across said base upon said impact of die sport ball to thereby absorb or attenuate translational energy of said sport ball, and wherein said act is sufficiently large so as to billow substantially entirely across said base and rearwardly substantially to said at least one brace leg.

13. The structure of claim 12 wherein said first pair of legs and said at least one brace leg are four legs formed by a pair of inflatable tubes criss-crossed at said vertex, said inflatable tubes arcuate when inflated so as to form arcuate arches defining said cavity and an archway around an upper perimeter of said entrance.

14. The structure of claim 13 wherein said inflatable tubes arc resilient, opposite ends of said inflatable tubes mounted to respective corners of said base, said inflatable tubes each of greater length than edge dimensions of said base and thus inflating arcuately when inflated so as to form said arches and archway.

15. The structure of claim 14 wherein said arches are substantially semi-circular.

16. The structure of claim 12 wherein said entrance is defined by a single arcuate inflatable tube forming a front pair of legs of said multi-pod and wherein said at least one brace leg is a separate pneumatic tube, separate from said single arcuate inflatable tube.

17. The structure of claim 16 wherein said at least one brace leg is linear when inflated, and pneumatically connected to said single arcuate inflatable tube by an auxiliary airway for simultaneous inflation of both said tubes.

18. The structure of claim 16 wherein said base is substantially in the shape of an isosceles triangle.

19. The structure of claim 18 wherein said base includes three straps extending from and linearly between said lower ends.

20. The structure of claim 18 wherein said base consists solely of three straps extending from and linearly between said lower ends.

* * * * *